US005934944A

United States Patent [19]

Aoyama et al.

[11] Patent Number: 5,934,944

[45] Date of Patent: Aug. 10, 1999

[54] BLOCK CONNECTOR

[75] Inventors: Masahiko Aoyama; Hitoshi Okumura, both of Yokkaichi, Japan

[73] Assignee: Sumitomo Wiring Systems, Ltd., Japan

[21] Appl. No.: 08/969,811

[22] Filed: Nov. 13, 1997

[30] Foreign Application Priority Data

Nov. 14, 1996 [JP] Japan ..... 8-303360

[51] Int. Cl.[6] ..... H01R 13/502

[52] U.S. Cl. ..... 439/701

[58] Field of Search ..... 439/717, 701, 439/357, 358

[56] References Cited

U.S. PATENT DOCUMENTS 5,122,077 6/1992 Maejima et al. .

5,320,555 6/1994 Okabe ..... 439/701

FOREIGN PATENT DOCUMENTS 590568 8/1977 Switzerland ..... 439/701

*Primary Examiner*—Gary Paumen

*Assistant Examiner*—Briggitte R. Hammond

*Attorney, Agent, or Firm*—Anthony J. Casella; Gerald E. Hespos; Ludomir A. Budzyn

[57] ABSTRACT

A block connector is provide to facilitate a disengaging operation. The block connector invention is constructed by placing an upper housing A and a lower housing B one over the other. Lock projections A7, A8 are provided at front and rear sides of the left and right side surfaces of the upper housing A, and corresponding lock holes B3, B5 are provided in the lower housing B. The lock projections A7, A8 are formed with locking surfaces A7*b*, A8*b* and disengagement guide surfaces A7*c*, A8*c* for smoothly disengaging the lock projections A7, A8 from the lock holes B3, B5. Further, jig insertion holes B6 for inserting a disengaging jig E are formed in the front surface of the lower housing B. The lock projection A7 and the lock hole B3 can be disengaged by inserting the disengaging jig E into the jig insertion hole B6 and prizing the jig insertion hole B6 with the disengaging jig E. Thereafter, if the forcibly opened front ends of the housings A, B are rotated about the rear ends thereof, the lock projections A8 and the lock holes B5 can be disengaged.

7 Claims, 6 Drawing Sheets

BLOCK CONNECTOR

BACKGROUND OF THE INVENTION

1. Field of the Invention

The present invention relates to a block connector, particularly having a construction which can be easily disassembled.

2. Description of the Prior Art

A known block connector as shown in FIG. 10, is constructed such that housings 1, 2 and 3 are placed one over another. Rear halves of the upper surfaces of the respective housings 1, 2 and 3 are opened so that wires can be connected with unillustrated terminal fittings mounted in the housings 1, 2 and 3. In the housings 1 and 2 lock portions 4 project downwardly in front and rear positions of left and right side surfaces. When the housings 1, 2 and 3 are placed one over another, the lock portions 4 of the housings 1, 2 are engageable with lock projections provided on the lower located housings 2 and 3. In this way, the housings 1, 2 and 3 are connected with each other to assemble the block connector integrally.

The block connector assembled by placing the housing 1, 2 and 3 sometimes needs to be disassembled. For example, the block connector needs to be disassembled when it needs to be repaired because of the deformation of the terminal fittings or the necessity to replace the terminal fittings. In such a case, the lock portion 4 normally is deformed forcibly in an outward direction by inserting a jig having a flat leading end inside it. The lock portion 4 then is disengaged from the lock projection 5. By disengaging all lock portions 4, the housings 1, 2 and 3 can be separated from each other to complete the disassembling operation. Direct forces by the jig that are intended to disengage the lock portions 4, may actually damage or overstress the lock portions 4, with the result that the lock portion may not function to lock the housings.

The present invention was developed in view of the above problem and an object thereof is to provide a block connector which can be easily disassembled without damaging the function of lock portions (lock means).

SUMMARY OF THE INVENTION

According to the invention, there is provided a block connector constructed by fitting or placing a plurality of housings substantially one over or on another. At least one lock means is provided on each housing and comprises a lock portion and an engaging portion which are engageable with each other between the housings placed substantially one over the other. A jig insertion portion for disengaging the lock means is provided between the housings placed one over the other in a position where the lock means is not provided.

Accordingly, when the respective housings are placed substantially one over another, the lock portions and the engaging portions are engaged, thereby holding the housings placed one over another. Thus, the block connector is integrally assembled. When the integrally assembled block connector is desired to be disassembled, the disengaging operation is performed by inserting a jig into the jig insertion portion, thereby disengaging the lock portions and the engaging portions to separate the respective housings from each other. Accordingly, the disengaging operation can be performed without directly forcibly deforming the lock portions or the engaging portions, and thereby preventing the lock portions and the engaging portions from being damaged or having their functions impaired.

According to a preferred embodiment of the invention, a desired number of lock means are provided and, in at least one of the lock means, at least one of the lock portion and the engaging portion is provided with a disengagement guide surface for guiding the lock portion and the engaging portion in their disengaging direction.

Accordingly, since the disengagement guide surface is provided on at least one of the lock portion and the engaging portion constructing the lock means, the lock portion and the engaging portion can be smoothly disengaged, facilitating the disengaging operation.

Preferably, at least one of the lock means comprises a lock projection and a lock hole into which the lock projection is pressed or pressable. The lock projection and the lock hole preferably are provided on or in joining surfaces of the housings. Accordingly, the housings can be held one over the other and can be positioned with respect to each other when the lock portion and the engaging portion are engaged. Further, if at least one of the lock projection and the lock hole is formed with the disengagement surface for guiding the lock projection and the lock hole in their disengaging direction, the lock projection and the lock hole can be easily disengaged even if the lock means is provided on the joining surfaces and the disengaging operation can be easily performed.

Further preferably, the lock means is arranged at each of first or front and second or rear end portions of the housings. The first or front end side lock means is disengaged by a disengaging operation at the jig insertion portion. The second or rear end side lock means is disengaged by a rotating operation to rotate the front ends of the housings away from each other about a position in vicinity of the rear end side lock means.

Accordingly, since the lock means is provided at each of the first or front and second or rear end portions of the housings, the housings can be more securely held placed substantially one over the other. Further, since the second or rear end side lock means can be disengaged by the rotating operation to rotate the front ends of the housings away from each other after the front end side lock means is disengaged by the disengaging operation at the jig inserting portion, it is not cumbersome to separate the housings from each other. Accordingly, the disengaging operation can be easily performed while the housings are securely held placed one over the other.

Still further preferably, the first or front end si de lock means is provided on an engaging surface with a mating connector, and the second or rear end side lock means is provided at a side where wires are withdrawn from the housings.

Accordingly, the wires hinder neither the disengaging operation at the jig inserting portion nor the rotating operation to disengage the second or rear end side lock means. Thus, the disengaging operation can be performed easily even if the wires are connected.

Most preferably, the lock means comprises at least one lock projection projecting from one side surface of one of the housings placed substantially one over the other and a lock hole formed in a projected portion projecting from the other housing to the one housing. The disengagement guide surface preferably is formed by obliquely cutting off a corner of the lock projection.

Accordingly, the housings can be held more securely one over the other by the engagement of the lock projection and the lock hole. Further, since the corner of the lock projection preferably is cut off to form the disengagement guide surface, the lock projection and the lock hole easily can be disengaged, thereby facilitating the disengaging operation.

According to a further preferred embodiment, the lock projection is provided with a hook portion, wherein the disengagement guide surface is preferably formed on the hook portion.

These and other objects, features and advantages of the present invention will become more apparent upon a reading of the following detailed description and accompanying drawings.

DETAILED DESCRIPTION OF THE PREFERRED EMBODIMENTS

The block connector according to the first embodiment is constructed as shown in FIGS. 1–8 such that an upper housing A and a lower housing B are placed substantially one over the other or fitted substantially to each other and a cover C is mounted on the lower surface of the lower housing B. The housings A and B are constructed such that female terminal fittings D can be connected with wires W while being mounted in unillustrated cavities.

First, the female terminal fittings D to be assembled with the respective housings A and B are briefly described. Each female terminal fitting D is formed e.g. by bending a conductive thin metal plate such that, as shown in a right upper part of FIG. 1, a connection portion DI, is formed at its front part (left side in FIG. 1), a contact portion D2 is provided substantially adjacent the connection portion D1 and a barrel D3 is formed at the rear end of the terminal fitting D. The connection portion D1 is configured to have a mating male tab inserted therein. The contact portion D2 is configured to have a wire W brought into pressing contact. The barrel D3 is fastenable to an insulation coating of the wire W.

The upper housing A includes a plurality of unillustrated cavities are arranged preferably side by side. The female terminal fittings D are mounted into these cavities through openings at the rear sides (right side of FIG. 1) of the cavities. The rear half of the lower surface of the upper housing A has an opening, and a connecting jig is insertable into the respective cavities through this opening. Thus, the female terminal fittings D can be connected with the wires W after being mounted in the cavities.

On the upper surface of the upper housing A is formed a lock arm A1 with one end thereof fixed and the other end thereof hanging. The lock arm A1 is formed with a lock projection A2 engageable with a mating connector housing and an unlock member A3 which is operated to deform the lock arm A1 to disengage the lock projection A2 from the mating connector housing. Protection walls A4 stand along the left and right edges of the upper surface of the upper housing A to prevent foreign matter from entering below the lock arm A1. Further, torsion or deflection or warp restricting portions A5 for preventing the lock arm A1 from deflecting or warping in a direction opposite to the disengaging direction of the lock arm A1 are provided preferably at the rear ends of the protection walls A4.

Figure 5:
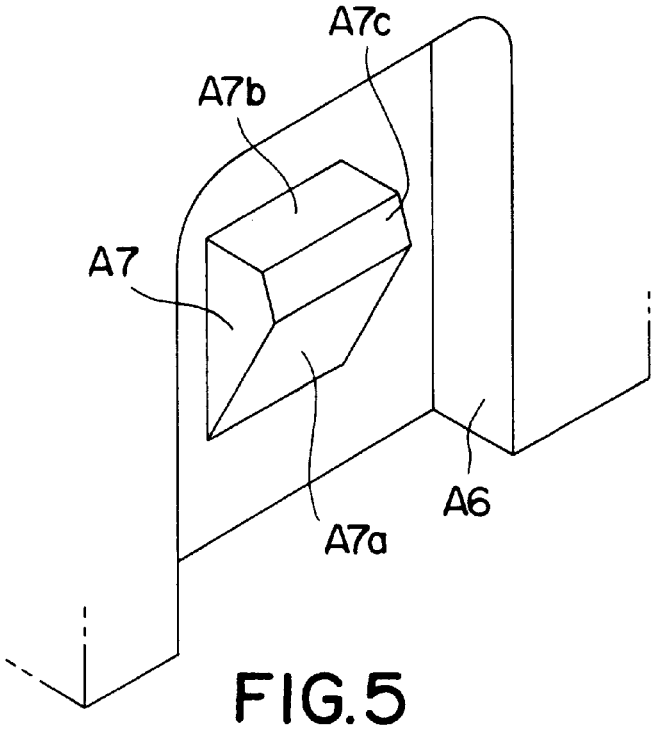
FIG. 5 is a perspective view of a lock projection at a front end side.

A substantially rectangular recess A6 is formed at the front end of each of the left and right side surfaces of the upper housing A, and lock projections A7 (being part of the first or front end side lock means) are provided therein. As shown in FIG. 5, the lock projection A7 projects substantially along vertical direction from the side surface of the upper housing A and obliquely extends downwardly. This downward slanting surface is an engagement guide surface A7*a* which facilitates the engagement of the lock projection A7 with a lock hole B3. Further, the upper surface of the lock projection A7 extending substantially along normal direction from the side surface of the upper housing A is a locking surface A7*b* which engages the upper edge of the lock hole B3 to prevent the lock projection A7 from disengaging from the lock hole B3. The corner of the locking surface A7*b* and the engagement guide surface A7*a* is bevelled, and this bevelled surface is a disengagement guide surface A7*c* which facilitates the disengagement of the lock projection A7 from the lock hole B3 when a force is applied to a jig insertion hole B6 to be described later. In other words, although the lock projection A7 and the lock hole B3 are not disengaged from each other in a normal state, they are easily disengageable if the jig insertion hole B6 is pried with a disengaging jig E.

Figure 6:
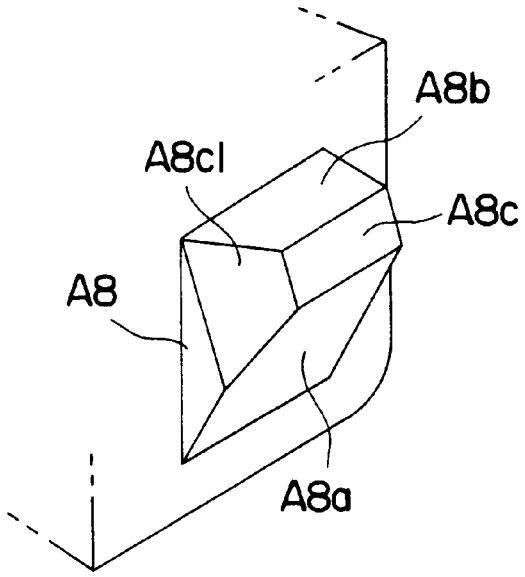
FIG. 6 is a perspective view of a lock projection at a rear end side.
Figure 7:
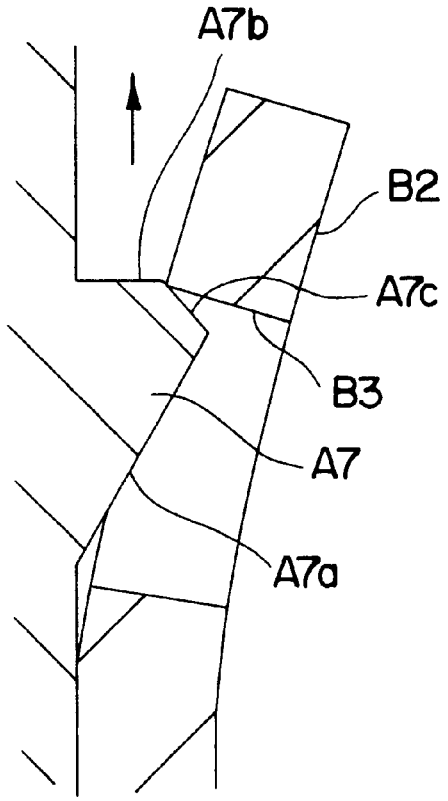
FIG. 7 is an enlarged section showing an intermediate stage of the disengagement of the lock projection at the front end side.
Figure 8:
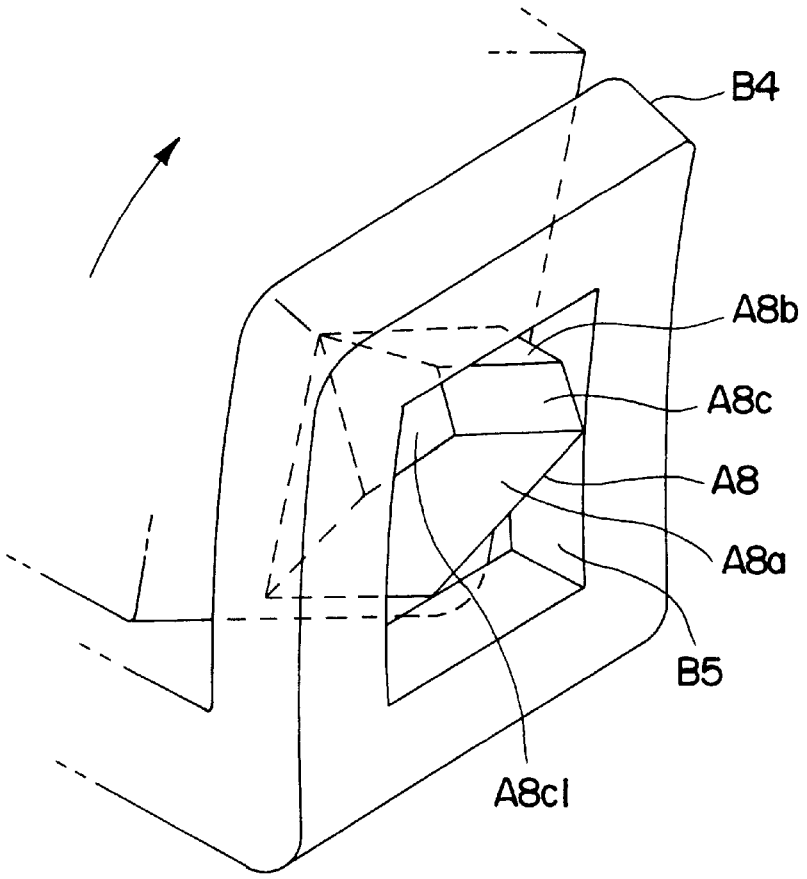
FIG. 8 is an enlarged section showing an intermediate stage of the disengagement of the lock projection at the rear end side.

A lock projection A8 (being part of the second or rear end side lock means) is formed at the rear end of each of the left and right side surfaces of the upper housing A. As shown in FIG. 6, this lock projection A8 also is formed with an engagement guide surface A8*a* and a locking surface A8*b* similar to the lock projection A7. Further, the corner of the locking surface A8*b* and the engagement guide surface A8*a* is bevelled to form a projecting surface A8*c*, and a front end of the projecting surface A8*c* is obliquely cut off to form a disengagement guide surface A8*c*1. When the housings A and B are rotated away from each other about their rear ends, the lock projections A8 come out of lock holes B5 to be described later by being guided by the disengagement guide surfaces A8*c*1. It is sufficient that the center of rotation in this case be displaced from, e.g. more backward than the lock projections A8. In other words, it is sufficient that the center of rotation be located in a position at a distance from the lock projection A8 such that the lock projections A8 and the lock holes B5 are disengageable by a rotating operation. The position "in vicinity of the second or rear end side lock means" refers to such a position.

The lower housing B includes a plurality of cavities are arranged preferably side by side inside the lower housing B similar to the upper housing A. The female terminal fittings D are mounted into the cavities through an opening at a rear side of the lower housing B. Further, similar to the upper housing A, the rear half of the lower housing B has an opening, and a connecting jig is insertable into the respective cavities through this opening. Thus, the female terminal fittings D can be connected with the wires W after being mounted in the cavities.

A plurality of ribs B1 are formed preferably side by side along substantially transverse direction on the upper surface of the lower housing B. The ribs B1 push the wires W connected with the female terminal fittings D assembled with the upper housing A by bringing the upper surface of the lower housing B and the lower surface of the upper housing A substantially together. Further, lock portions B2, each formed with a substantially rectangular lock hole B3, (being part of the first or front end side lock means) project at the left and right edge of the front end of the upper surface of the lower housing B. The lock portions B2 are so sized that they can be fitted or inserted into the recesses A6 of the upper housing A and the lock projections A7 are fitted or inserted into the lock holes B3. On the left and right edges of the rear end of the upper surface of the lower housing B are formed substantially accommodating portions B4 for accommodating the rear ends of the left and right side walls of the upper housing A, and a rectangular lock hole B5 (being part of the second or rear end side lock means) is formed in the outer wall of each accommodating portion B4. In other words, the lock projections A7 and A8 are fitted or fittable into the lock holes B3 and B5 by placing or fitting the upper housing A substantially on or to the lower housing B.

The front edge of the upper surface of the lower housing B is obliquely cut off preferably in two positions at the left and right sides where the jig insertion holes B6 are formed for receiving the disengaging jig E when the upper surface of the lower housing B and the lower surface of the upper housing A are put together. The jig insertion holes B6 correspond to the jig insertion portion according to the invention. By inserting the disengaging jig E into the jig insertion hole B6 and prying the jig insertion hole B6 with the disengaging jig E, the housings A and B can be displaced in such a direction to disengage the lock projections A7 from the lock holes B3.

The cover C is so sized as to substantially close the opening of the lower housing B, and a plurality of ribs C1 are formed preferably side by side along substantially transverse direction on the upper surface of the cover C. When the cover C is mounted in a position to close the opening of the lower housing B, the respective ribs C1 push the wires W connected with the respective female terminal fittings D assembled with the lower housing B. On the opposite ends of the rear portion of the upper surface of the cover C are formed accommodating portions C2 for accommodating the rear ends of the left and right side walls of the lower housing B. A lock hole C3 is formed in the outer wall of each accommodating portion C2, so that lock projections B7 formed on the left and right side surfaces of the lower housing B are fitted or fittable into the lock holes C3 when the cover C is mounted in a position to substantially close the opening of the lower housing B.

To assemble the block connector according to this embodiment, the female terminal fittings D are mounted into the cavities of the respective housings A and B, and the wires W are connected with these female terminal fittings D using the connecting jig. The wires W connected with the female terminal fittings D are pulled out through the rear surfaces of the housings A and B.

The upper housing A is placed on the upper surface of the lower housing B. Then, the respective lock projections A7 and A8 are fitted into the lock holes B3 and B5 by being guided by the engagement guide surfaces A7*a* and A8*a*, with the result that the housings A and B are held substantially one over the other by the engagement of the respective locking surfaces A7*b* and A8*b* with the upper edges of the lock holes B3 and B5. The assembling of the block connector is completed by mounting the cover C on the lower surface of the lower housing B (see FIG. 2).

Figure 1:
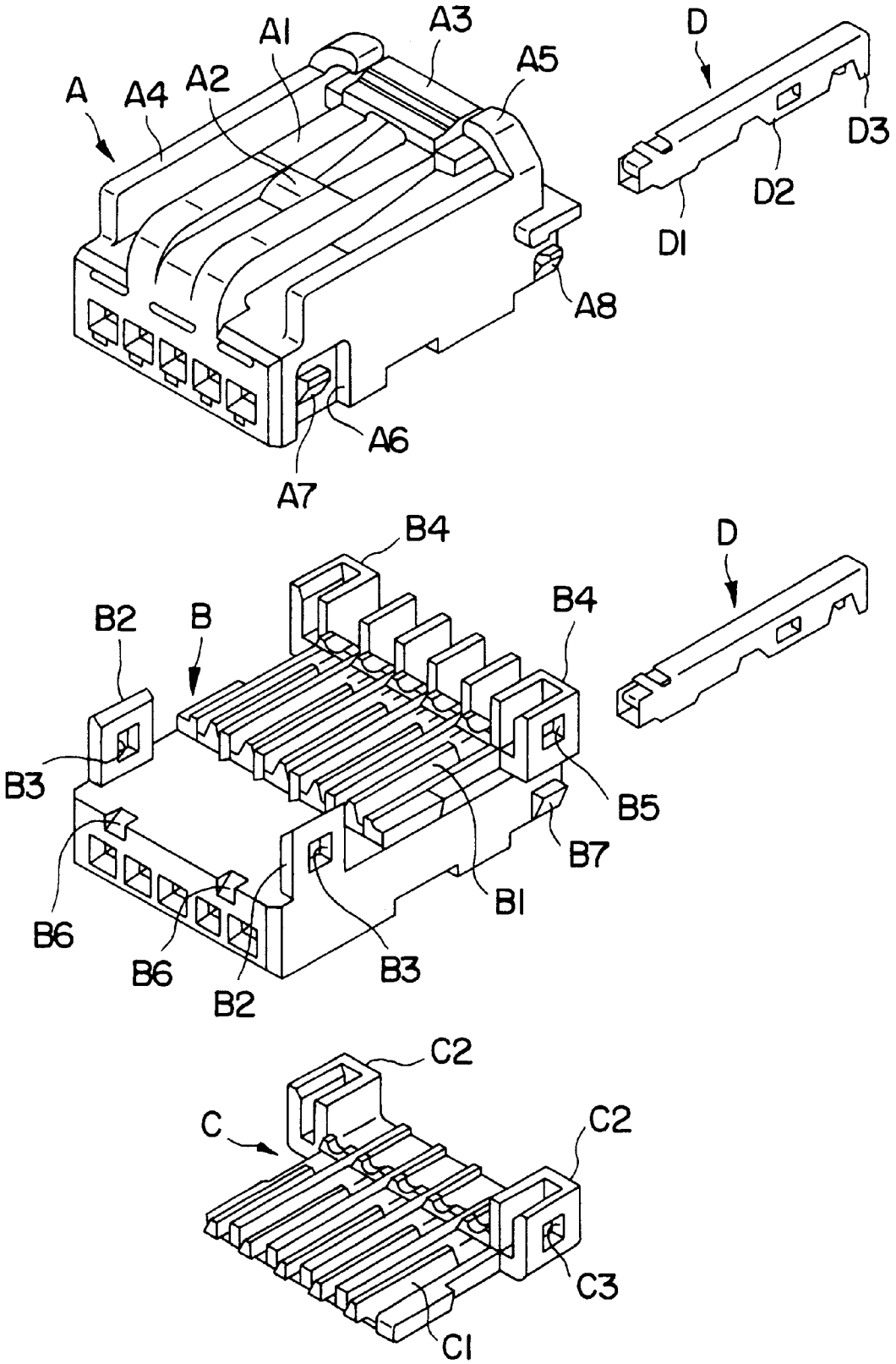
FIG. 1 is an exploded perspective view entirely showing one embodiment of the invention.
Figure 2:
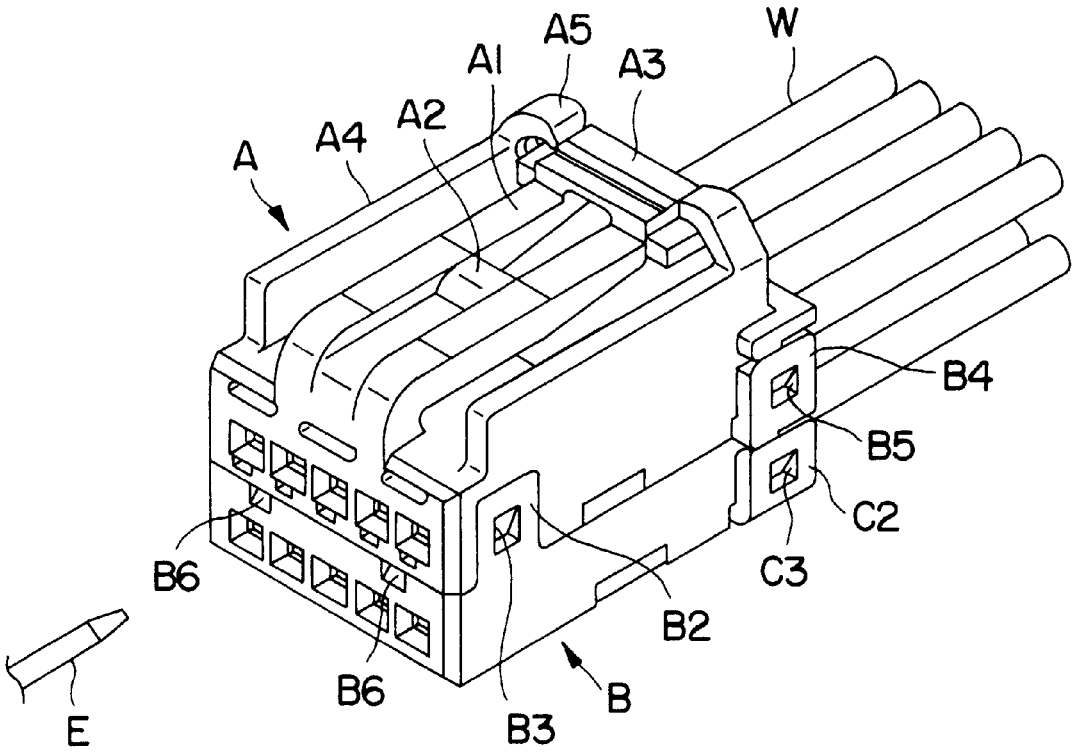
FIG. 2 is a perspective view of the embodiment in its assembled state.
Figure 3:
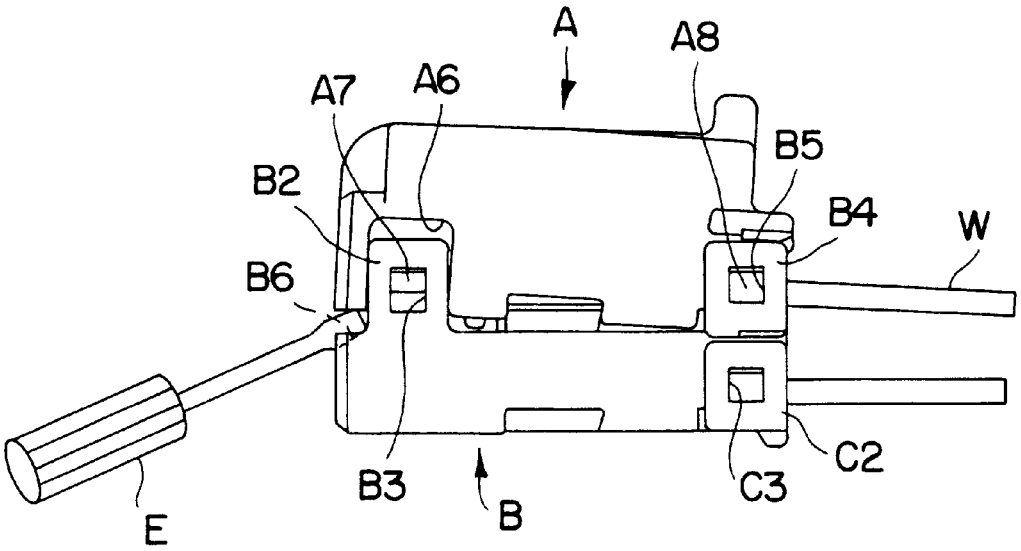
FIG. 3 is a side view showing a disengaging operation by a disengaging jig.

The block connector thus assembled is disassembled as follows when a necessity to repair or the like arises. First, as shown in FIG. 3, the leading end of the disengaging jig E is inserted into the jig insertion hole B6. The disengaging jig E is moved forcibly to lift the upper housing A. Then, the front ends of the housings A and B are displaced in a direction away from each other while the housings A and B are displaced slightly along transverse direction. As a result, the lock projections A7 come out of the lock holes B3 by being guided by the disengagement guide surfaces A7*c* while deforming or displacing the lock portions B2 outwardly, thereby being disengaged from the lock holes B3 (see FIG. 7).

Figure 4:
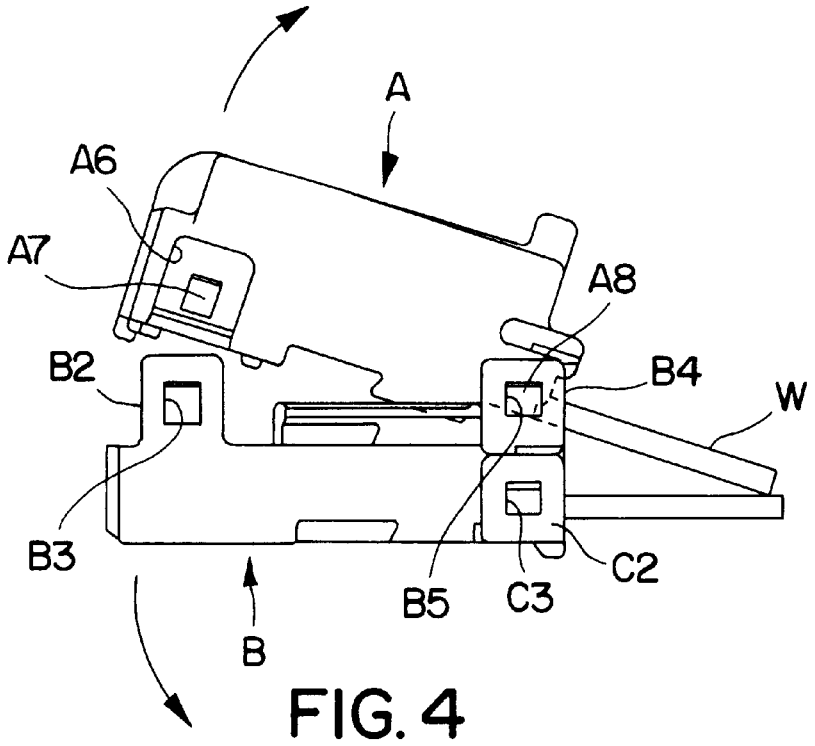
FIG. 4 is a side view showing a rotating operation.

Subsequently, as shown in FIG. 4, the housings A and B are rotated about their rear ends or rear end portions so as to open the pried front ends thereof. Then, the lock projections A8 provided at the rear end come out of the lock holes B5 by being guided by the disengagement guide surfaces A8*c*1 (see FIG. 8). As a result, the lock projections 8 and the lock holes B5 at the rear end are disengaged, and the housings A and B can be completely separated from each other. In this way, the disassembling operation is completed.

The embodiment thus constructed has the following effects.

By providing the special jig insertion holes B6, the lock projections A7 and A8 can be disengaged from the lock holes B3 and B5 without directly prying the outer walls of the lock portions B2 and the accommodating portions B4, thereby preventing the lock portions and the like from being damaged.

Since the housings A and B are displaced in the disengaging direction while the lock portions B2 are deformed outwardly by forcibly inserting the disengaging jig E, the lock portions B2 are not deformed outward to a larger degree than necessary for the lock projections A7 to come out of the lock holes B3. Accordingly, a force which is larger than necessary does not act on the lock portions B2, thereby preventing the function of the lock portions B2 from being damaged during the disassembling operation. As a result, the disassembling operation can be performed easily.

Further, since the lock projections A7 each are formed with the disengagement guide surface A7*c*, the lock projections A7 can disengaged smoothly from the lock holes B3 by prying the jig insertion holes B6 with the disengaging jig E.

Since the lock projections A7 and A8 and the lock holes B3 and B5 are provided substantially at the front and rear end sides, the housings A and B can be securely held one over the other. Further, even in this case, since the lock projections A8 and the lock holes B5 at the rear end side are disengaged by the rotating operation, the housings A and B can be easily disassembled.

Further, since the lock projections A8 each are formed with the disengagement guide surface A8*c*1, the lock projections A8 and the lock holes B5 can be disengaged smoothly by the rotating operation.

Since the jig insertion holes B6 are formed at the first or front end which is opposite from the side where the wires W are pulled out, the wires W do not hinder the disassembling operation by the disengaging jig E and the rotating operation of the front end. Thus, the disassembling operation can be performed easily even if the wires W are connected.

Although the lock projections A8 which are disengaged by the rotating operation are formed at the left and right side surfaces of the upper housing A, and the lock holes B5 into which the lock projections A8 are fitted are formed in the outer walls of the accommodating portions B4 of the lower housing B in the foregoing embodiment, the block connector may be constructed as follows.

Figure 9:
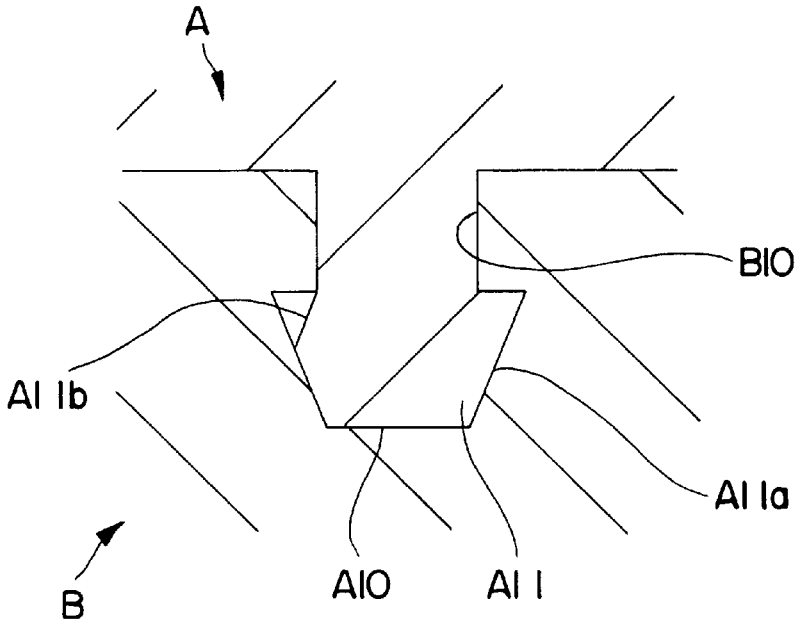
FIG. 9 is a section of an other embodiment.
Figure 10:
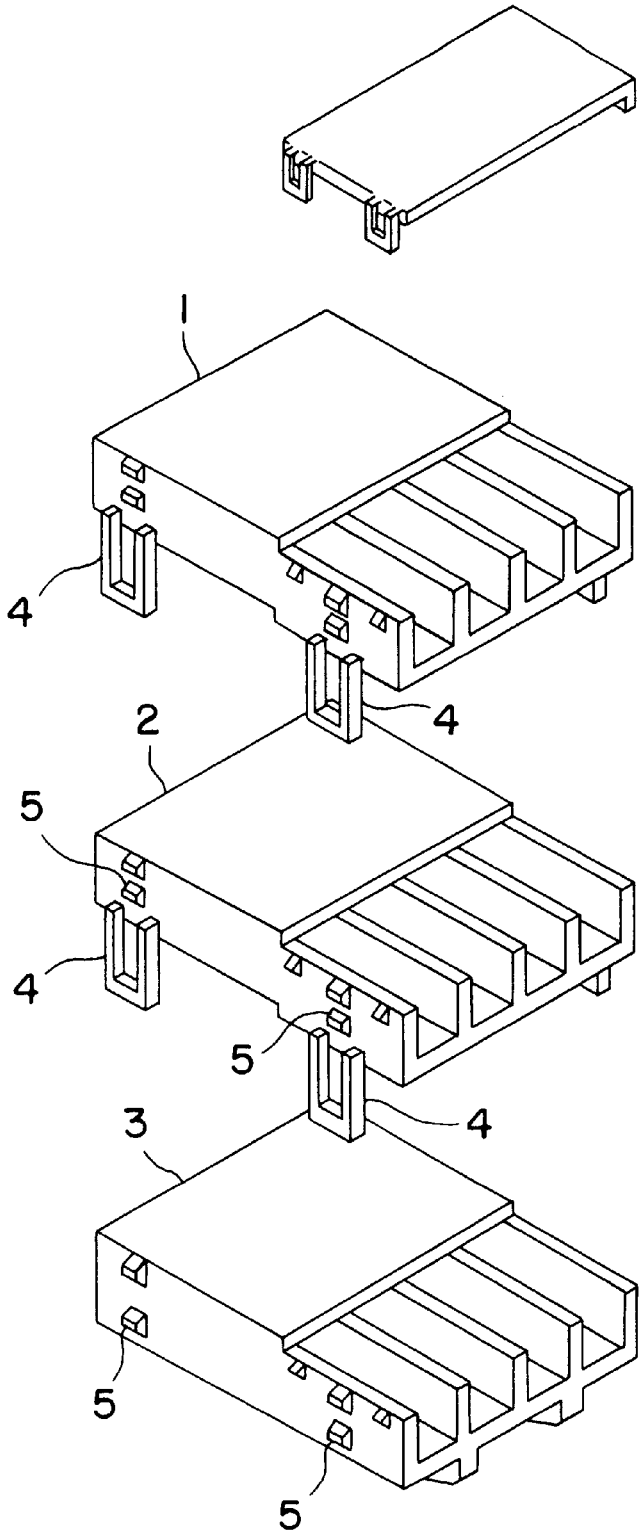
FIG. 10 PRIOR ART
FIG. 10 is an exploded perspective view of a prior art block connector.

As shown in FIG. 9, a lock projection A10 and a lock hole B10 into which the lock projection A10 is fitted or fittable are formed on or in the surfaces of the housings A and B which come together, i.e. the lock projection A10 projects from the lower surface of the upper housing A and the lock hole B10 is formed in the upper surface of the lower housing B. The leading end (lower end in FIG. 9) of the lock projection A10 slightly bulges outwardly to form an embossed or hook portion A11 which hooks the lock hole B10, and the hook portion A11 is formed with an engagement guide surface A11*a* so as to be fitted easily into the lock hole B10. Further, a front end of the hook portion A11 (left end in FIG. 9) which engages the lock hole B10 is partially obliquely cut off to form a disengagement guide surface A11*b*.

On the other hand, the lock hole B10 is sized such that the lock projection A10 can be pressed or fitted thereinto. The housings A and B are held positioned with respect to forward and backward directions and transverse direction by the engagement of the lock projection A10 and the lock hole B10.

Even in the case that the block connector is constructed such that the housings A, B are held positioned as above, by forming the disengagement guide surface A11*b*, the lock projections A10 easily come out of the lock hole B10 by being guided by the disengagement guide surface A11*b* if the housings A and B are rotated to open the front end in the same manner as in the foregoing embodiment. Accordingly, the block connector can be easily disassembled even if the lock projection A10 and the lock hole BIO act to position the housings A and B.

The present invention is not limited to the foregoing embodiments, but may be embodied as follows. These embodiments are embraced by the technical scope of the present invention as defined in the claims.

Although the invention is applied to the female block connector in the foregoing embodiment, it may be applied to a male block connector.

Although the lock projections A7 and A8 are formed on the upper housing A and the lock holes B3 and B5 engageable therewith are formed in the lower connector housing B in the foregoing embodiment, the lock holes may be formed in the upper housing and the lock projections may be formed on the lower housing.

Although the jig insertion holes B6 are formed in the front surface (engaging surface) in the foregoing embodiment, they may be formed in the left, right or rear side surfaces.

In the foregoing embodiment, the lock projections A7 and the lock holes B3 at the front end side are disengaged by the jig E and the lock projections A8 and the lock holes B5 at the rear end side are disengaged by the rotating operation. However, the construction may be, for example, such that the jig insertion holes are provided in the rear surface, and the lock projections and the lock holes at the front end side are disengaged by the rotating operation after the lock projections and the lock holes at the rear end side are disengaged by the jig. Alternatively, the jig insertion holes may be formed in both the front surface and the rear surface, and all lock projections and lock holes are disengaged by the jig.

Although two each of the lock projections A7 and A8 are arranged at the front and rear end sides, one each of them may be arranged at the front and rear end sides. Alternatively, two lock projections may be arranged at either of the front and rear end sides and one lock projection may be arranged at the other.

Although the disengagement guide surfaces A7*c* and A8*c* are formed on the lock projections A7 and A8 in the foregoing embodiment, they may be formed by cutting off the edges of the lock holes (B3 and B5).

Although the disengagement guide surfaces A7*c* and A8*c* are formed by cutting off one edge of the lock projections A7 and A8 in the foregoing embodiment, they need not be necessarily formed on the lock projections. It is sufficient that any desired portion of the housings be provided with a disengagement guide means for guiding the outer walls of the lock portions and accommodating portions in a direction to open outwardly.

Although the lock means which is disengaged by the rotating operation is constructed by the lock projection A10 and the lock hole B10 formed on the joining surfaces in the other embodiment, the lock means which is disengaged by the disengaging jig may be constructed by the lock projection and the lock hole formed on the joining surfaces.

Although a total of four lock means comprising the lock projections A7 and A8 and the lock holes B3 and B5 are provided between the housings A and B in the foregoing embodiment, the number of the lock means is not limited to 4. It is sufficient to provide at least one lock means.

Besides the following embodiments, a variety of changes can be made without departing from the spirit and scope of the present invention as defined in the claims.

What is claimed is:

1. A block connector comprising a plurality of housings placed substantially one over another, such that each of said housings has at least one other of the housings adjacent thereto to define at least one pair of adjacent housings, at least one lock pair provided on each said pair of adjacent housings and comprising a resiliently deflectable lock portion on a selected one of said housings in said pair of adjacent housings and an engaging portion on the other of said housings in the pair of adjacent housings, said lock portion and said engaging portion being engageable with each other when the housings are placed substantially one over the other, and a jig insertion opening provided between the housings in the pair of housings, such that said jig insertion opening is defined by portions of each of said housings in said pair of housings, said jig insertion opening being disposed in a position spaced from the lock pair so that the jig does not engage the resiliently deflectable lock portion and forces exerted by a jig on the housings at the jig insertion opening are substantially isolated from the resiliently deflectable lock portion, whereby said resiliently deflectable lock portion is not overdeflected by a jig during separation of the housings from one another.

2. A block connector according to claim 1, wherein a plurality of lock pairs are provided and, in at least one of the lock pairs, at least one of the lock portion and the engaging portion is provided with a disengagement guide surface for guiding the lock portion and the engaging portion in their disengaging direction.

3. A block connector according to claim 2, wherein at least one of the lock pairs comprises a lock projection and a lock hole into which the lock projection is pressed, which are provided on joining surfaces of the housings.

4. A block connector according to claim 1, wherein the lock pair is arranged at each of first and second end portions of the housings, the first end lock pair being disengageable by a disengaging operation at the jig insertion opening, and the second end lock pair being disengaged by rotating the first ends of the housings away from each other about a position in proximity to the second end lock pair.

5. A block connector according to claim 4, wherein the first end lock pair is provided on an engaging surface with a mating connector, and the second end lock pair is provided at a side where wires are withdrawn from the housings.

6. A block connector according to claim 2, wherein the disengagement guide surface is formed by obliquely cutting off a corner of the engaging portion.

7. A block connector according to claim 2, wherein the housings in the pair of adjacent housings comprise a pair of abutting surfaces, said lock pair being formed on the abutting surfaces, the lock projection being provided with a hook portion for engaging the engaging portion and, wherein the disengagement guide surface is formed on the hook portion.

* * * * *